United States Patent [19]

McCutcheon, Sr.

[11] 4,425,374

[45] Jan. 10, 1984

[54] METHOD OF MAKING ELECTRICAL CABLE

[75] Inventor: Joe R. McCutcheon, Sr., Malvern, Ark.

[73] Assignee: Reynolds Metals Company, Richmond, Va.

[21] Appl. No.: 371,602

[22] Filed: Apr. 26, 1982

[51] Int. Cl.[3] ..... B05D 3/06

[52] U.S. Cl. ..... 427/44; 156/51; 156/275.5; 264/174; 264/346; 427/120; 427/379; 427/388.2; 427/431; 427/434.6

[58] Field of Search ..... 156/47, 51, 275.5; 264/174, 346; 427/44, 379, 120, 388.2, 431, 434.6

[56] References Cited

U.S. PATENT DOCUMENTS

| | | | |
|---|---|---|---|
| 1,927,400 | 9/1933 | Gray et al. . | |
| 2,093,087 | 9/1937 | Lynn . | |
| 3,413,167 | 11/1968 | Trill | 156/51 |
| 3,579,379 | 5/1971 | Van Berkel et al. | 427/379 X |
| 3,635,621 | 1/1972 | Miyauchi et al. | 425/445 X |
| 3,965,226 | 6/1976 | Werwitzke et al. | 264/25 |
| 4,101,487 | 7/1978 | Peterson | 427/388.2 X |
| 4,229,238 | 10/1980 | Saito | 156/50 |
| 4,342,794 | 8/1982 | Volker et al. | 427/120 X |

*Primary Examiner*—Robert A. Dawson

*Attorney, Agent, or Firm*—Alan T. McDonald

[57] ABSTRACT

A method is disclosed for substantially reducing shrink back of thermosetting materials from electrical cable. The method comprises reheating the cable, after curing of the thermosetting material and cooling of the cable, to a temperature below the melting point of the thermosetting material.

9 Claims, 1 Drawing Figure

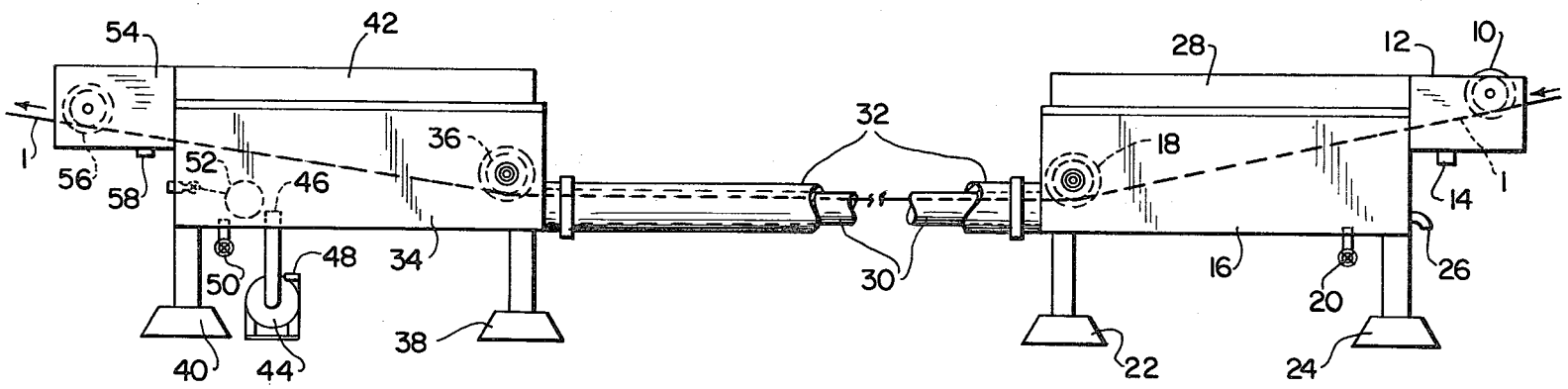
10
12
14
26
28
18
16
20
24
22
32
30
36
34
38
42
46
48
44
52
50
40
54
58
56
1
1

METHOD OF MAKING ELECTRICAL CABLE

BACKGROUND OF THE INVENTION

Electrical power cable for underground use is typically formed by coating a metallic conductor with one or more layers of thermosetting materials. If multiple coating layers are placed over the conductor, one or more of these layers may be of a semi-conducting material, with the remaining layers being of insulating material. The layers are coated or extruded onto the conductor in an uncured, molten state. After coating, the cable is heated to a termperature sufficient to cure the insulating layer or layers, followed by a cooling under pressure of the now-cured cable. Some additional curing may occur during the cooling cycle.

The conductor may be composed of a plurality of strands of a conducting metal, such as aluminum or copper, or could be in the form of a single conductor rod or strand.

In the past, the curing operation was often carried out in a tubular conduit which was heated and pressurized by steam.

More recently, the steam heating tubes have increasingly been replaced by radiant heat curing, with the curing taking place in a tubular conduit under inert gas pressure. Other curing alternatives include circulating heated gases, liquids salts and irradiation of the cable.

In any case, and particularly, but not entirely, when a single conductor cable is formed, the insulation has a tendency to "shrink back" after cooling, resulting in exposure of a length of bare conductor at either end of the completed cable.

The shrink back tendency may not be observable during cable production. The problem occurs most often when cable is subjected to alternating heating and cooling cycles, and may become apparent when cable is subjected to electrical current passing through it for a time period, followed by a time span with no current passing through the cable, sometimes referred to as a load cycle. Purchasers require that electrical cable not shrink back more than a specified amount in a load cycle test.

It is desirable, therefore, to reduce the conductor exposure by substantially reducing insulation shrink back.

THE PRESENT INVENTION

By means of the present invention, this desirable goal has been obtained. According to the present invention, a method for significantly reducing shrink back of thermosetting materials from an electrical cable conductor is provided. According to the method of the present invention, the cured and cooled electrical cable is reheated to a temperature slightly below the melting point of the thermosetting material. This reheating of the cable substantially reduces or eliminates the tendency for the thermosetting material to shrink back from the conductor.

BRIEF DESCRIPTION OF THE DRAWING

The method of the present invention will be more fully described with reference to the FIGURE, which is a side elevational view of an apparatus suitable for reheating of insulated electrical cable according to the method of the present invention.

DETAILED DESCRIPTION OF THE PREFERRED EMBODIMENT

Turning now to the FIGURE, insulated electrical cable 1 enters a "spillover box" 12 and is guided through the box 12 by means of guide pulley 10 positioned therein. The cable 1 has been coated, cured and cooled in any of numerous ways. For example, the cable 1 could be formed according to the radiant cure methods disclosed in any of U.S. Pat. Nos. 3,513,228, 3,588,954, 3,635,621, 3,645,656 or 4,035,129, the disclosures of which are hereby incorporated herein by reference. Alternatively, the cable 1 could be cured by steam curing. The cable 1 could be arriving at spillover box 12 directly from the curing and cooling operation, or, the cable 1 may be taken out of the line of production and have been wound and now unwound to accomplish this procedure.

Spillbox 12 includes a drain 14 to permit water to be emptied therefrom, for reasons to be illustrated below.

The cable 1 next passes to an entering tank 16, where it is guided along its path by means of guide pulley 18. Tank 16 is partially filled with water, and includes a water inlet 26 and a drain 20. The tank 16 is supported upon legs 22 and 24 and includes a cover member 28, which cover member 28 is preferably formed of a transparent plastics resin, such a polycarbonate, to permit viewing of the operations within the tank. The tank 16, as well as spillbox 12, tank 34 and spillbox 54 are formed of sheet metal.

The cable 1 next passes through a pipe 30 which is covered by insulation 32, such as glass fiber insulation. The length of pipe 30 may vary, based upon the speed of the line and the amount of heat necessary to treat the cable 1. Thus, this pipe 30 may have a length from about 100 to 200 or more feet (39.6 to 79.2 meters).

As previously mentioned, the cable 1 could be treated according to the present method in-line with its production according to one of the incorporated by reference U.S. Pat. Nos. 3,513,228, 3,588,954, 3,635,621, 3,645,656 or 4,035,129. As such, its speed of travel through pipe 30 would be the same as that through the production system. Knowing the permissable speeds of travel and permissable range of lengths of pipe 30, permissable times of reheating may readily be calculated.

Next, the cable 1 enters a exit tank 34, which also is partially filled with water. The cable 1 here is guided by means of guide pulley 36. Tank 34 rests upon legs 38 and 40 and includes a cover 42, similar to cover 28 previously described. Tank 34 also includes drain 50, similar to drain 20. The water inlet for tank 34 comprises a pump 44 having an inlet 48 connected to a source of heated water (not shown) and discharging through outlet 46. The water which circulates through the system by means of pump 46 may be a temperature ranging between about 170° to 205° F. (76.6° to 96.1° C.), which is a temperature far lower than the 750° F. (398.9° C.) or so pipe temperature employed for curing of the cable 1 in a radiant cure system or the 350°–450° F. (176.7° to 232.2° C.) of the steam employed in a steam curing operation. The temperature is also below the melting point of the thermosetting material covering cable 1.

To maintain a proper level of water in the tanks 16 and 34 and to maintain pipe 30 in a filled condition during operation, a water level sensor 52 is employed. This sensor 52 is in the form of a floating ball valve which is connected by conventional means (not shown) to regulate pump 44.

The cable 1 leaves the system through exiting spillbox 54, where it is guided by guide pulley 56. Similar to spillbox 12, spillbox 54 includes a drain 58.

The operation of the system is thus straightforward. The cable 1 enters the system, is heated by the hot water circulating within tanks 16 and 34 and to pipe 30, and exits the system after reheating thereof.

The exact mechanism by which the method of the present invention reduces shrink back is unknown. It is theorized, however, that the reheating of the insulation to a temperature below its melting point relieves or rearranges radial stresses placed in the thermosetting material during its curing and cooling, and this stress relief or arrangement enables the material to more firmly grip the conductor.

The reheating of the cable 1 has been illustrated by passing the cable 1 through a heated liquid medium, such as water. The invention is not so limited. Any means which reheats the cable insulation to a temperature slightly below its melting point could be employed. However, it has been found that the liquid, and preferably water, reheating as illustrated, provides the most efficient heat transfer mechanism to the cable 1.

From the foregoing, it is clear that the present invention provides a simple and straightforward method for significantly reducing shrink back in insulated electrical cable.

While the invention has been described with reference to certain specific embodiments thereof, it is not intended to be so limited thereby, except as set forth in the following claims.

I claim:

1. In a method of forming insulated electrical cable comprising surrounding a conductor with a thermosetting material in a molten state, heating said cable to thereby cure said thermosetting material to a solid state and cooling said cable after curing of said thermosetting material, the improvement comprising reheating said cable after said cooling thereof to a temperature below the melting point of said cured thermosetting material for a time sufficient to thereby prevent shrink back of said cured thermosetting material from said conductor.

2. The method of claim 1 wherein said conductor comprises a single strand.

3. The method of claim 1 where said conductor comprises a multi-strand conductor.

4. The method of claim 1 wherein said cable is reheated to a temperature between about 170° to 205° F. (76.7° to 96.1° C.).

5. The method of claim 1 wherein said cable is cured by radiant heating.

6. The method of claim 1 wherein said cable is cured by steam heating.

7. The method of claim 1 wherein said cable is cured by circulating hot gases.

8. The method of claim 1 wherein said cable is cured by liquid salts.

9. The method of claim 1 wherein said cable is cured by irradiation.

* * * * *